US005758785A

United States Patent [19]

Spinosa et al.

[11] Patent Number: 5,758,785

[45] Date of Patent: Jun. 2, 1998

[54] LIFTING SYSTEM

[76] Inventors: Dominic Spinosa, 1766 Roland Ave., Wantagh, N.Y. 11793; Frank Knoll, 15 Candy La., Huntington Station, N.Y. 11746; Joseph Gaito, 316 Center La., Levittown, N.Y. 11756

[21] Appl. No.: 664,513

[22] Filed: Jun. 17, 1996

Related U.S. Application Data

[60] Provisional application No. 60/000,447 Jun. 22, 1995.

[51] Int. Cl. [6] ..... B66C 23/78

[52] U.S. Cl. ..... 212/300; 212/303; 212/232; 212/901

[58] Field of Search ..... 414/543; 212/180, 212/296, 299, 300, 301, 304, 306, 348, 901, 253, 232, 303, 252, 302; 52/118

[56] References Cited

U.S. PATENT DOCUMENTS

| | | | |
|---|---|---|---|
| 798,666 | 9/1905 | Derx . | |
| 884,307 | 4/1908 | Winemiller et al. . | |
| 951,621 | 3/1910 | Shorts | 52/118 |
| 1,489,161 | 4/1924 | Schuchert | 212/901 |
| 1,614,697 | 1/1927 | Snook . | |
| 1,828,905 | 10/1931 | Mossay | 212/901 |
| 2,023,790 | 12/1935 | Ormsby et al. . | |
| 2,193,047 | 3/1940 | Truitt et al. | 212/303 |
| 2,289,487 | 7/1942 | Dickson | 212/180 |
| 2,409,929 | 10/1946 | Cohen . | |
| 2,759,604 | 8/1956 | Carpenter . | |
| 2,782,940 | 2/1957 | Beseler | 212/252 |
| 2,804,979 | 9/1957 | Lassiter . | |
| 2,846,082 | 8/1958 | Heitz | 212/253 |
| 2,906,501 | 9/1959 | Brell | 212/304 |
| 2,918,181 | 12/1959 | Hanson | 212/303 |
| 2,976,033 | 3/1961 | Martin . | |
| 3,024,925 | 3/1962 | Werner et al. . | |
| 3,085,798 | 4/1963 | Gavette . | |
| 3,298,539 | 1/1967 | Sundstrom | 212/300 |
| 3,362,548 | 1/1968 | Cunningham | 212/304 |
| 4,050,587 | 9/1977 | Moen | 212/301 |
| 4,239,196 | 12/1980 | Hanger . | |
| 4,446,975 | 5/1984 | Konig | 212/300 |
| 4,597,498 | 7/1986 | Spirosa et al. | 212/901 |
| 5,076,448 | 12/1991 | Ballard | 212/301 |

FOREIGN PATENT DOCUMENTS

| | | | |
|---|---|---|---|
| 1580387 | 9/1969 | France | 212/348 |
| 2509708 | 1/1983 | France | 212/304 |
| 3615295 | 11/1987 | Germany | 212/901 |
| 689214 | 4/1965 | Italy | 212/300 |
| 99146 | 10/1955 | Norway | 212/189 |
| 352811 | 4/1961 | Switzerland | 212/306 |

*Primary Examiner*—Thomas J. Brahan
*Attorney, Agent, or Firm*—Frederick N. Samuels

[57] ABSTRACT

A lifting system for removing and installing equipment on aircraft. The lifting system comprises a base and a lifting assembly supported by the base. The lifting system also comprises linear outriggers and at least one offset outrigger. The linear outriggers and the at least one offset outrigger are connectable to the base to provide additional stability for the lifting system during operation. The lifting assembly includes a boom having telescoping sections. The boom may be tilted about a horizontal axis relative to the base and rotated about a vertical axis relative to the base for increased maneuverability around and increased access to the aircraft.

11 Claims, 15 Drawing Sheets

LIFTING SYSTEM

This application claims the benefit of U.S. provisional application Ser. No. 60/000,447, filed on Jun. 22, 1995.

BACKGROUND OF THE INVENTION

1. Field of the Invention

The present invention relates to a lifting system, and more particularly, to a lifting system for removing and installing equipment on aircraft.

2. Discussion of the Prior Art

Currently, cranes, hoists and other lifting systems are widely utilized in diverse applications ranging from building construction to aircraft, ship and submarine construction. Many of these applications simply require the lifting system to lift and transport the various articles of construction from one point to a second point. However, there are also certain applications where the lifting system must be of a unique design to fulfill the particular needs of the application, for example, limited maneuvering space. Accordingly, there are numerous variations in lifting system design.

In the aircraft industry, both commercial and military, many of the components and assemblies comprising the aircraft are heavy, relatively delicate, and generally expensive. In addition, these same components and assemblies are typically located in difficult to reach portions of the aircraft. Accordingly, lifting systems utilized in the construction of, or in the maintenance of aircraft, must be easily maneuverable around and under the aircraft, and able to access difficult to reach portions of the aircraft in addition to being able to lift and transport heavy loads safely. Currently utilized lifting systems are cumbersome and not able to move in and around the aircraft, require more than one individual to operate, and are difficult to transport.

SUMMARY OF THE INVENTION

In accordance with one aspect, the present invention is directed to a lifting system. The lifting system comprises a base, a lifting assembly, a plurality of linear outriggers and at least one offset outrigger. The lifting assembly is mounted to the base. The plurality of linear outriggers and the, at least one offset outrigger are detachably connected to the base to provide stability during operation. The offset outrigger includes an upper end vertically offset from a lower end thereof.

In accordance with a further aspect, the present invention is directed to an outrigger arrangement for a lifting system. The outrigger arrangement comprises a plurality of outriggers and at least one offset outrigger. The plurality of outriggers are removably connected to a base of the lifting system to stabilize the lifting system during operation. The at least one offset outrigger is removably connected to the base of the lifting system and includes an upper end vertically offset from a lower end.

In accordance with a further aspect, the present invention is directed to a lifting system. The lifting system comprises a base having an upper surface and an opening therein, and a lifting assembly mounted on the base for lifting a load. The lifting assembly includes a boom having a plurality of telescoping sections, at least one of which is retractable through the opening to a position below the surface of the base.

In accordance with a further aspect, the present invention is directed to a lifting system. The lifting system comprises a base and a lifting assembly mounted on the base for lifting a load. The lifting assembly includes a boom and a foldable lifting arm movable between a retracted position and an extended position in which the foldable lifting arm extends transversely from the boom.

The exemplary lifting system of the present invention may be utilized in any particular field; however, it is particularly well suited for use in the construction and repair of aircraft. The exemplary lifting system of the present invention provides for a safe, reliable and expedient means for installing and removing various components and assemblies in military and commercial aircraft. The exemplary lifting system may be utilized in internal environments such as in a hangar, or in external environments such as the flightline. The exemplary lifting system may be manually powered and operated, and may be transported in either the transport mode or the deployment mode. One person can transport, set-up and position, operate, and stow the exemplary lifting assembly. Because no external power is required, the exemplary lifting system is immediately operable, and may be utilized in remote locations. Alternatively, the crane may be powered electrically, hydraulically, or pneumatically.

The exemplary lifting system of the present invention has the reach, height and lift capacity to facilitate the installation and/or removal of a wide range of aircraft components and assemblies including ejection seats, canopies, windshields, wing and tail sections, wing and tail control surfaces, and armament. In addition, the exemplary lifting system may be highly maneuverable for greater lifting system access. The platform of the exemplary lifting system may be low profile and thereby may be positioned under military aircraft without having to remove external fuel tanks or armament. The exemplary lifting system utilizes telescoping outrigger assemblies and jacks for added stability during use.

The exemplary lifting system of the present invention comprises a simple, rugged, and lightweight design. The controls and instrumentation may be ergonomically positioned such that an individual may efficiently and safely perform all maintenance and assembly functions for which the lifting system was designed to facilitate. The exemplary lifting system is constructed from sturdy, corrosion resistant, lightweight components for optimum maneuverability and mobility. In addition, the exemplary lifting system preferably meets or exceeds all standards set forth for military applications.

The exemplary lifting system of the present invention is a functional, cost and maintenance effective system for providing safe and reliable lifting capabilities for use specifically with aircraft. The simple design allows the lifting system to be quickly and easily assembled and disassembled. Additionally, the simple design reduces the required maintenance, and makes all maintenance and repairs easy to implement. The exemplary lifting system is designed so that it may be easily broken down into a package of minimal volume for storage and/or shipping.

DESCRIPTION OF THE PREFERRED EMBODIMENTS

Figure 1:
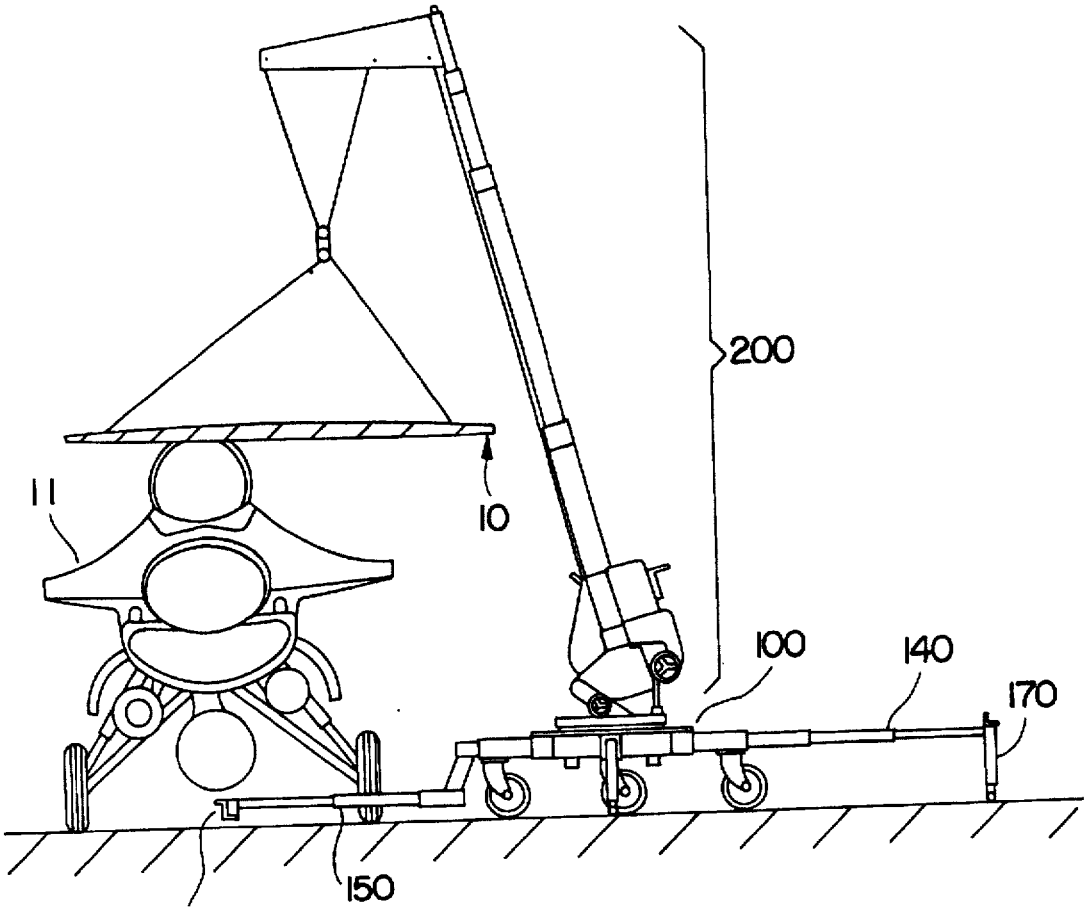
FIG. 1 is a side view of an embodiment of a lifting system according to the present invention during a lifting operation.
Figure 2:
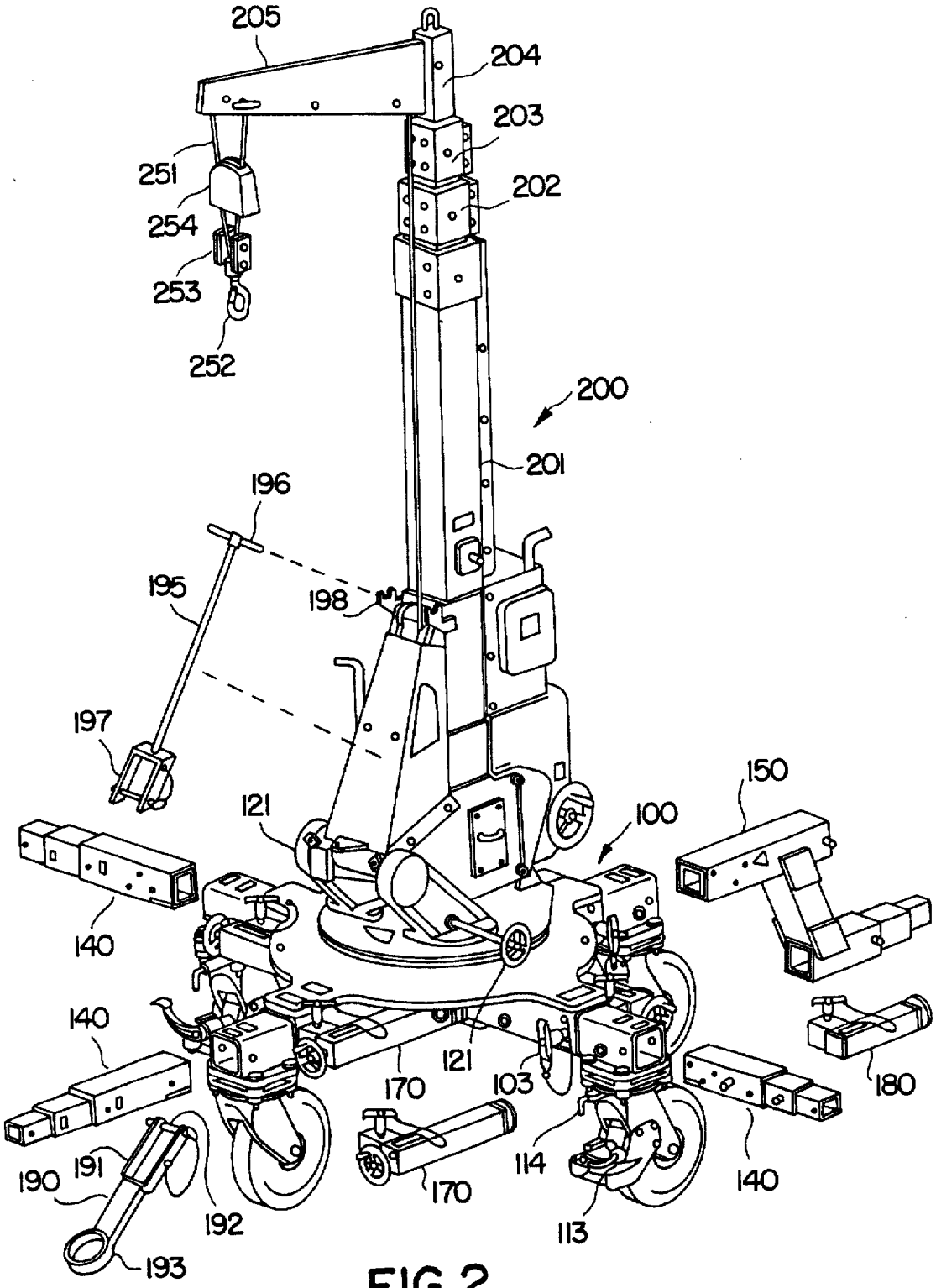
FIG. 2 is a perspective view of the lifting system of the embodiment of FIG. 1 in a partially disassembled state.

FIGS. 1–9 illustrate an exemplary embodiment of a lifting system according to the present invention. In FIG. 1, the lifting system is illustrated in the process of lifting a load, such as an aircraft wing 10, while in the vicinity of an object providing limited headroom, such as an aircraft 11 on which the wing 10 is to be mounted. FIG. 2 illustrates the lifting system of the exemplary embodiment of FIG. 1 in a partially disassembled state. The lifting system includes a mobile base 100, a lifting assembly 200 which is supported by the base 100, and a plurality of outriggers 140 and 150 which may be connected to the base 100 to increase its stability during a lifting operation. At least one of the outriggers 150 has an outer end which is vertically offset from its inner end so that the outer end may pass beneath an object with low clearance.

The base 100 may have any structure which enables it to stably support the weight of the lifting assembly 200. Preferably, the base 100 is mobile so that it may be pulled to a desired location where the lifting operation is to be performed. In this embodiment, the base 100 includes a cross-shaped frame 101, a flat support plate 105 mounted atop the frame 101, and a plurality of casters 112 secured to the frame 101 to enable the base 100 to be rolled about. The casters 112 may be permanently secured to the frame 101, or more preferably in this embodiment, each of the casters 112 is part of a caster assembly 110 which may be detachably connected to the frame 101 to permit the lifting system to be disassembled into conveniently sized components for shipping or storage.

The frame 101 has four legs 102 comprising hollow tubes of rectangular cross section which are welded to each other at right angles to form a cross. The four legs 102 may be joined in any other suitable configuration and by any suitable means such as bolts. Each of the caster assemblies 110 includes one of the casters 112 secured to a leg 111 comprising a hollow tube of rectangular cross-section which is sized to telescope into one of the four legs 102 of the frame 101 of the base 100. The leg 111 of each caster assembly 110 may be detachably secured to one of the legs 102 of the frame 101 by an engaging member, such as a quick-release pin 103 which passes through a hole formed in the leg 111 of the caster assembly 110 and one of the legs 102 of the frame 101.

The casters 112 in this embodiment are of conventional structure and are able to rotate about a horizontal axle as well as to pivot about a vertical axis. One or more of the casters 112 may be equipped with a brake 113, such as a foot brake, for preventing the caster 112 from rolling and a swivel lock 114 for preventing the caster 112 from swiveling about the vertical axis. The brakes 113 and swivel locks 114 may be of conventional structure. The illustrated embodiment of the lifting system employs four casters 112, but any number may be used, with the number preferably being sufficient to stably support the base 100.

The caster assemblies 110 may also comprise shock absorbers. Each shock absorber may be positioned between the leg 111 and the caster 112 of the caster assembly 110 to reduce the effects of shock caused by transporting the lifting system over an uneven surface. Shock absorbers may be particularly advantageous when lifting and transporting delicate objects.

Figure 4:
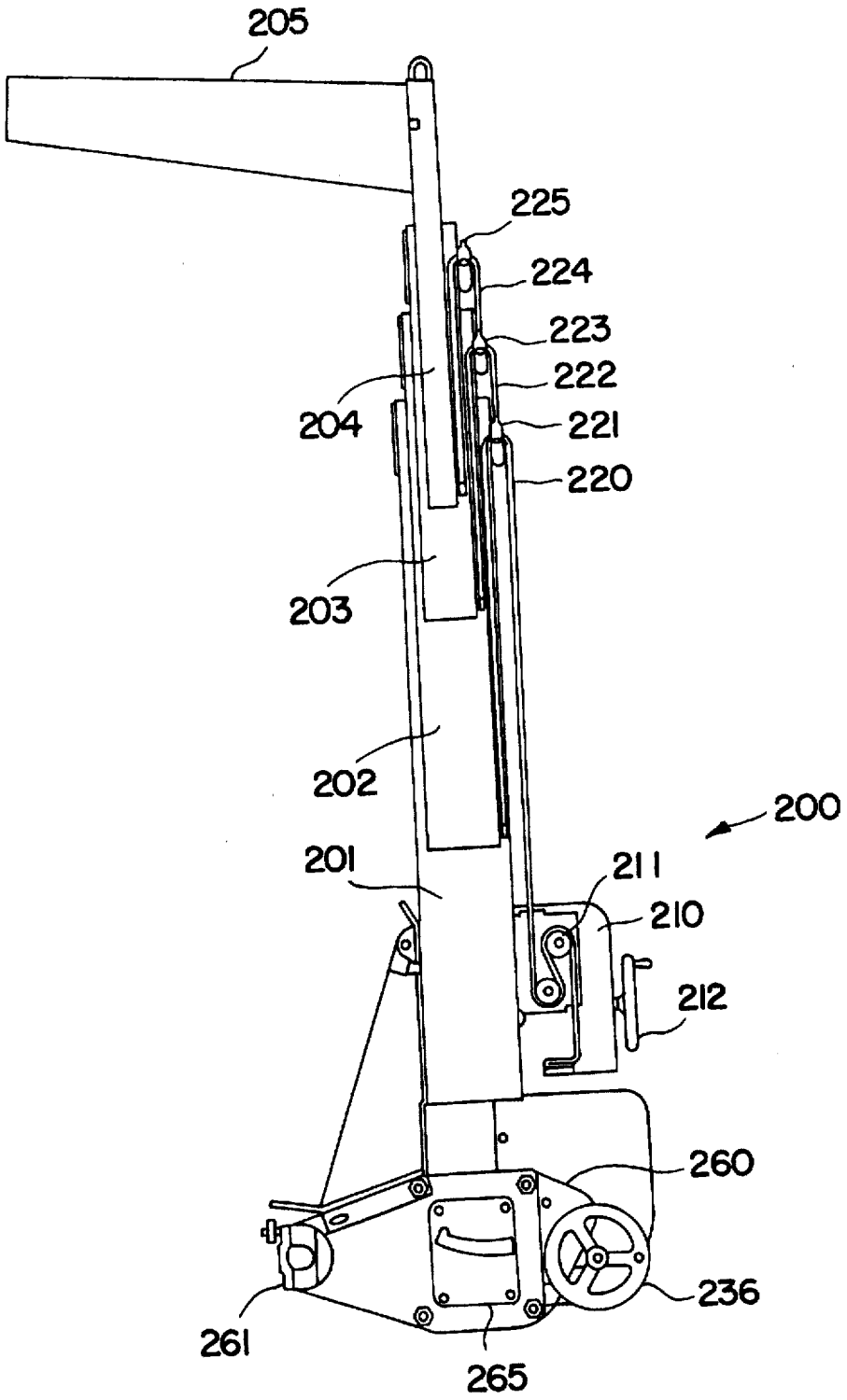
FIG. 4 is a broken away side elevation of the lifting assembly of the embodiment of FIG. 1.

The lifting assembly 200 includes a plurality of telescoping booms 201–204 and a lifting arm 205 extending transversely from the uppermost boom 204. The number and length of the booms may be selected in accordance with the desired height of the lifting system. The booms 201–204 may be raised and lowered with respect to the base 100 by any type of mechanism. The illustrated exemplary embodiment employs a mechanism similar to that used to raise and lower fire ladders on a fire truck. As illustrated in FIG. 4, the mechanism for raising and lowering the booms 201–204 includes a first drive chain 220 which is secured to the lower end of the second boom 202, passes around a sprocket 221 secured to the upper end of the first boom 201, and then passes around drive sprockets 211 of a drive unit 210 mounted on the lower portion of the lifting assembly 200 in a position where the drive unit 210 may be easily operated by a person standing beside the base 100. A second drive chain 222 is secured to the lower end of the third boom 203, passes around a sprocket 223 secured to the upper end of the second boom 202, and is secured to the upper end of the first boom 201. A third drive chain 224 is secured to the lower end of the fourth boom 204, passes around a sprocket 225 secured to the upper end of the third boom 203, and is secured to the upper end of the second boom 202. The drive sprockets 211 may be rotated by a hand wheel 212 drivingly connected to the drive sprockets 211 through an unillustrated reduction gear in the drive unit 210. Alternatively, the drive sprockets 211 may be rotated by a motor. The slack lower end of the first drive chain 220 is formed into a stack beneath the drive sprockets 211. For clarity, protective covers which normally surround the drive chains, the drive unit 210, and the sprockets have been omitted from FIG. 4. For increased strength, the drive chains may be multiple-strand chains having a plurality of strands disposed in parallel. Cables, belts, or similar members may also be used instead of chains.

Figure 3:
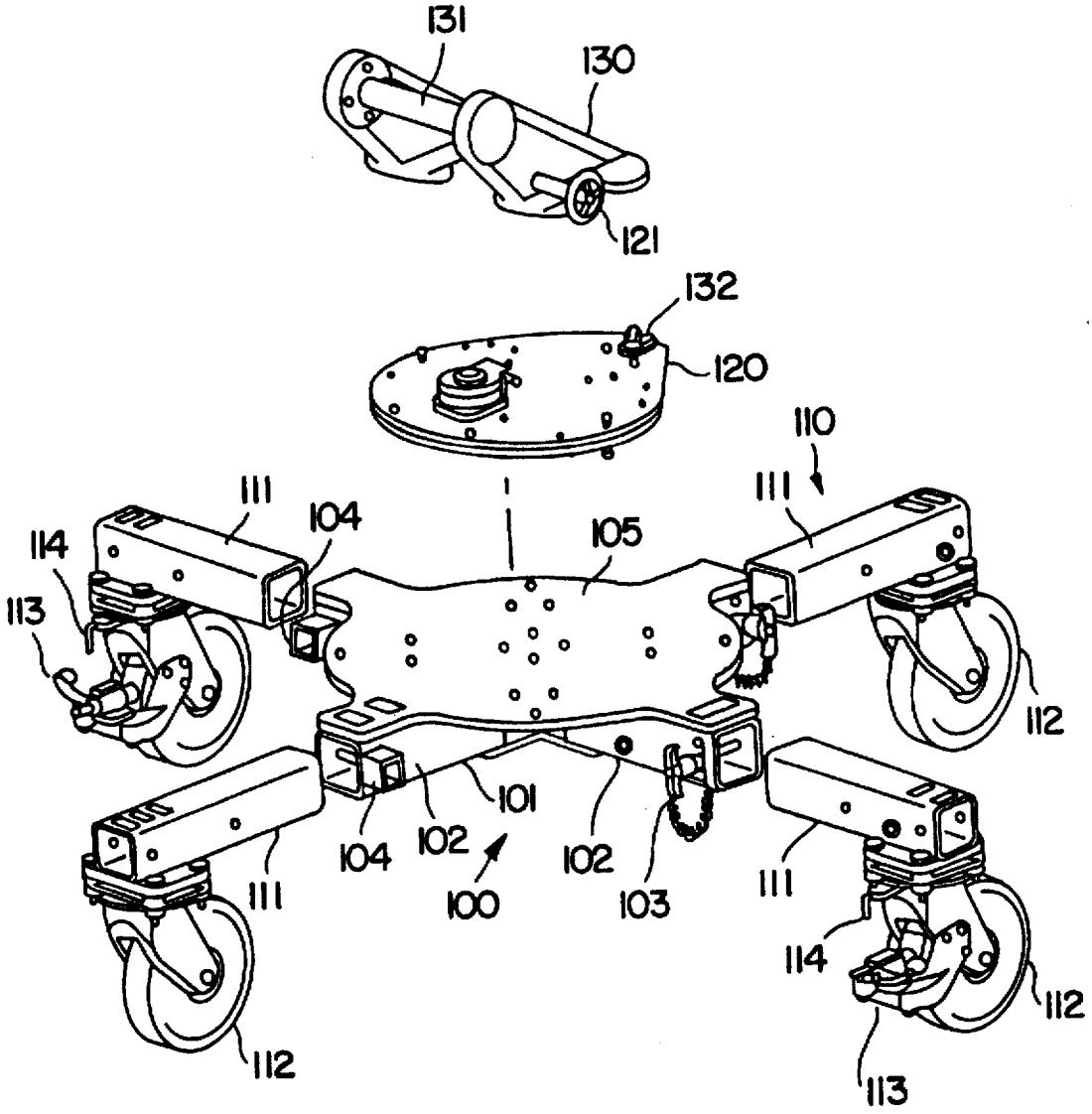
FIG. 3 is an exploded perspective view of the base of the lifting system of the embodiment of FIG. 1.
Figure 5:
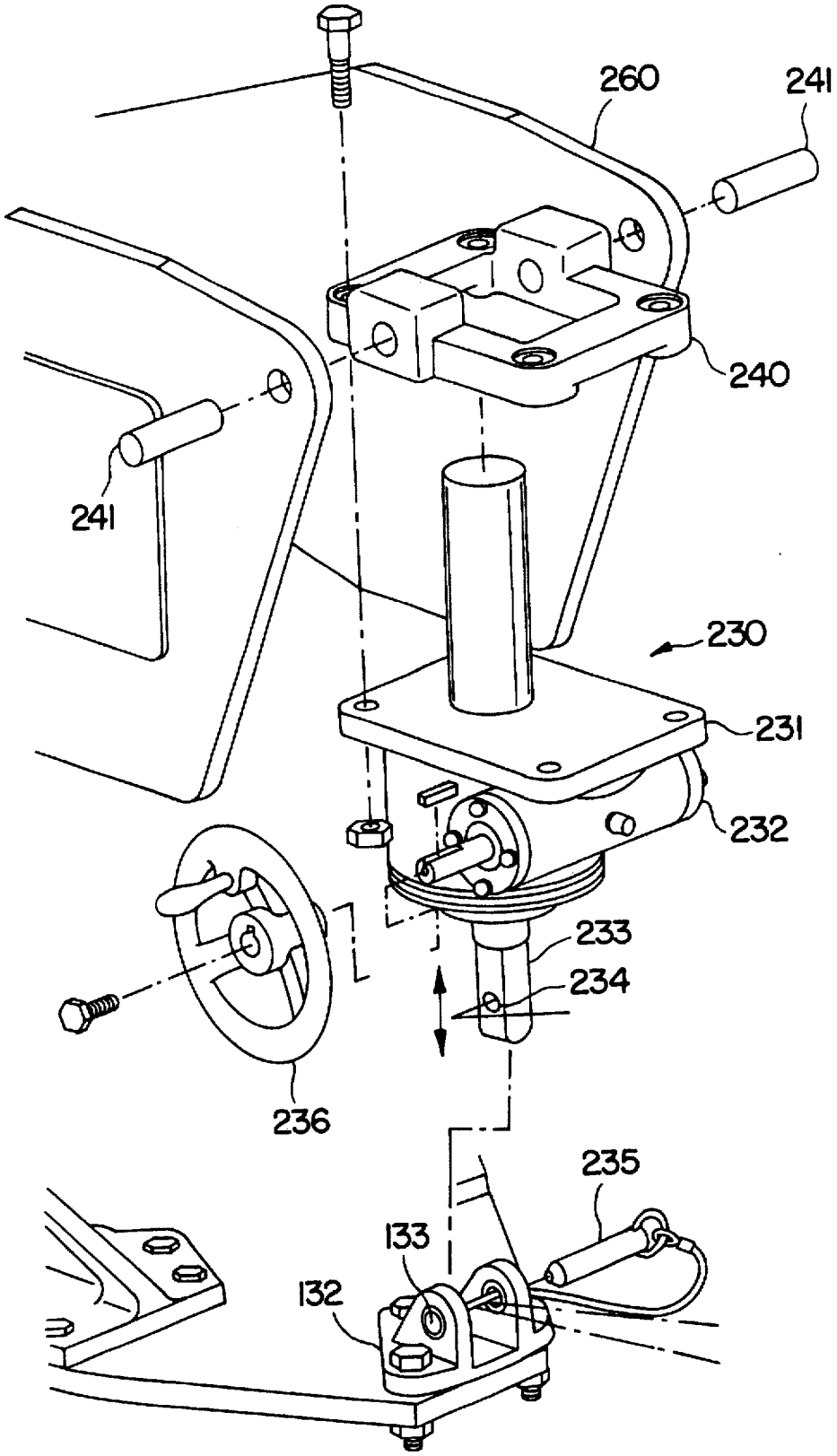
FIG. 5 is an exploded perspective view of the rear portion of the lifting assembly of the embodiment of FIG. 1.

The lifting assembly 200 is preferably pivotably mounted on the base 100 so that it may be tilted about a horizontal axis. As illustrated in FIG. 3, the base 100 includes a front support bracket 130 having a horizontal shaft 131, and a forward end of a frame 260 of the lifting assembly 200 includes jaws 261 (illustrated in FIGS. 4 and 6) which rotatably fit around the shaft 131 to permit the lifting assembly 200 to pivot about the shaft 131. A rear support bracket 132 is mounted on the base 100 beneath the rear end of the lifting assembly 200, and a conventional hand-powered tilt actuator 230, illustrated in FIG. 5, is connected between the frame of the lifting assembly 200 and the rear support bracket 132. The tilt actuator 230 has a base 231 and a drive mechanism 232 mounted on the base 231. The drive mechanism 232, which may be a rack and pinion mechanism, for example, has an output shaft 233 which may be advanced and retracted with respect to the base 231 in the direction of the arrows by the turning of a hand wheel 236 secured to the drive mechanism 232. The base 231 of the actuator 230 is secured to a bracket 240 which is pivotably connected to a frame 260 of the lifting assembly 200 by pins 241 in a location spaced from the shaft 131 of the front support bracket 130. The output shaft 233 of the actuator 230 is pivotably secured to the rear support bracket 132 by a quick-release pin 235 which passes through holes in the rear bracket 132 and a hole 234 in the output shaft 233. When the hand wheel 236 is rotated, the movement of the output shaft 233 relative to the base 231 raises or lowers the base 231 and exerts a torque on the frame 260 of the lifting assembly 200 about the shaft 131 of the front support bracket 130, changing the angle of tilt of the lifting assembly 200 with respect to the vertical. In this embodiment, the lifting assembly 200 may be tilted by up to 18 degrees with respect to the vertical, but the angle of tilt may be any value which does not cause the crane to lose its balance. The lifting assembly 200 may be equipped with a conventional inclinometer 265 to assist the operator in maintaining the angle of tilt within a safe range.

The lifting assembly 200 is preferably supported by the base 100 such that the lifting assembly 200 can be rotated about a vertical axis while the base 100 remains stationary. Any type of mechanism or rotation assembly may be employed to provide this rotational movement. In the present embodiment, the lifting assembly 200 is mounted on a turntable 120 of conventional design secured to the base 100. The turntable 120 may be rotated when the crane is fully loaded about a vertical axis by hand wheels 121 mounted on either side of the front support bracket 130. Preferably, the turntable 120 is capable of rotation by up to 360 degrees. Provision of more than one hand wheel 121 for rotating the turntable makes it possible for an operator of the lifting system to stand in a location which is most convenient for him during operation. The hand wheels 121 may be replaced with a different type of drive mechanism, such as a motor.

A lifting hook 252 for attachment to a load is suspended from the lifting arm 205 by a cable 251. The hook 252 may be raised and lowered by a winch 250 mounted near the bottom of the lifting assembly 200 in a position where it may be easily operated by a person standing beside the base 100. The winch 250 may be hand powered, as in this embodiment, or it may be motor driven. The cable 251 extends from the winch 250 to a first pulley 206 on the inner end of the lifting arm 205, over a second pulley 207 on the outer end of the lifting arm 205, and then down to a snatch block 253 or other type of pulley connected to the hook 252. After passing around the snatch block 253, the cable 251 extends back upwards to the lifting arm 205 and is detachably secured to the arm 205 at one of a plurality of attachment points 208 by an engaging member such as a quick-release pin 209 to which the end of the cable 251 may be attached and which passes through holes formed in the lifting arm 205 at each attachment point 208. The provision of a plurality of attachment points 208 at different locations on the lifting arm 205 makes it possible to adjust the bending moment applied to the lifting arm 205 by a load by changing which attachment point 208 the end of the cable 251 is attached to. The snatch block 253 may be fitted with a protective cover 254 (see FIG. 2) which can be slid upward along the cable 251 when it is desired to open the snatch block 253. The protective cover 254 may be utilized to protect aircraft components during installation and removal procedures. The snatch block 253 includes a spring load snap hook which maintains tension on the cable 251.

During transport of the lifting system in an unloaded or lightly loaded state, the casters 112 provide the base 100 with adequate stability. However, when the crane is being used to lift loads at some distance from the base 100, the outriggers 140 and 150 may be connected to the base 100 to increase the stability of the lifting system. The outriggers 140 and 150 need not have any particular structure, but preferably at least one of the outriggers has an outer end which is vertically offset with respect to the legs 102 of the base 100 so that it may be installed in a location where there is low headroom. The lifting system of the present embodiment is equipped with three linear outriggers 140 and one offset outrigger 150, but the number of different types of outriggers may be varied. For example, all of the outriggers may be offset outriggers.

Each of the linear outriggers 140 comprises a plurality of rigid telescoping sections 141–143. Each section comprises a tube of rectangular cross section. The sections can be made of any material having adequate strength. Extruded aluminum tubing is particularly suitable because of its high strength to weight ratio. The innermost section 141 is shaped to fit into the opening in the outer end of the leg 111 of any one of the caster assemblies 110. The linear outriggers 140 may be used in any position between a fully contracted state (illustrated in FIG. 2) and a fully extended state (shown in FIG. 1). Adjoining sections may be fixed to each other with a desired amount of overlap by engaging members such as quick-release pins 145 which may be inserted through holes 144 formed in the sections. In order to assist an operator in aligning a hole 144 in one section of the outrigger 140 with a hole 144 in the adjoining section, each outrigger 140 may be equipped with a detent mechanism, such as the spring-loaded plungers 146 shown in FIG. 7. When adjoining sections of the outrigger 140 are overlapped such that the holes 144 of the adjoining sections are aligned, each plunger 146 engages with a hole or recess formed in the adjoining section of the outrigger 140 to prevent the movement of the adjoining section. Index marks 147 may also be provided on the outer surface of the outrigger sections to indicate to the operator when the holes 144 of adjoining sections are approximately aligned. Preferably, all of the linear outriggers 140 have the same structure and dimensions to permit them to be used interchangeably, but outriggers 140 of different sizes may be used if desired. The number of sections in each of the linear outriggers 140 is arbitrary.

The offset outrigger 150 comprises an upper section 151 which may engage with the opening in the outer end of any one of the caster legs 111 and a plurality of telescoping lower sections 152–155 disposed beneath the upper section 151 and having a structure similar to the sections of the linear outriggers 140. Like the sections of the linear outriggers 140, they may be made of any material having suitable strength, a preferred example being extruded aluminum tubing. The innermost section 152 of the lower sections is rigidly secured to the upper section 151 by a connecting member 156. In this embodiment, the offset outrigger 150 has four lower sections, but a different number of sections may be used. In addition, although the upper section 151 is illustrated as a single rigid member, it may instead comprise a plurality of telescoping sections. Preferably, the upper section 151 and the innermost section 152 of the lower sections have the same transverse cross section so that lower sections 153–155 may be telescoped into either section 151 or section 152. For example, when the lifting system is being rolled about, it may be more convenient to insert sections 153–155 into section 151 than into section 152 because they will be higher off the ground and less likely to interfere with obstructions on the ground. On the other hand, when it is desired to extend the outrigger 150 beneath an object having little clearance, sections 153–155 may be inserted into section 152. The sections 153–155 may be secured to one another and to section 151 or section 152 with a desired amount of overlap by engaging members such as quick-release pins 158 which may be inserted into holes 157 formed in the sections. Each of sections 151–154 is equipped with a detent mechanism in the form of a spring loaded plunger 159 secured to its outer end for assisting an operator in aligning the holes 157 of adjoining sections. Each plunger 159 is capable of engaging with a corresponding hole 160 in an adjoining one of the sections of the outrigger 150. When an operator desires to secure two nested sections to each other with a pin 158, the operator pulls outward on one of the sections until the plunger 159 on one section engages with the hole 160 in the adjoining section, upon which the holes 157 in the two sections will be aligned so that one of the pins 158 may be inserted through the holes 157. Sections 153–155 are also equipped with index marks 161 on their outer surface for assisting an operator in adjusting the amount of overlap between sections.

Figure 7:
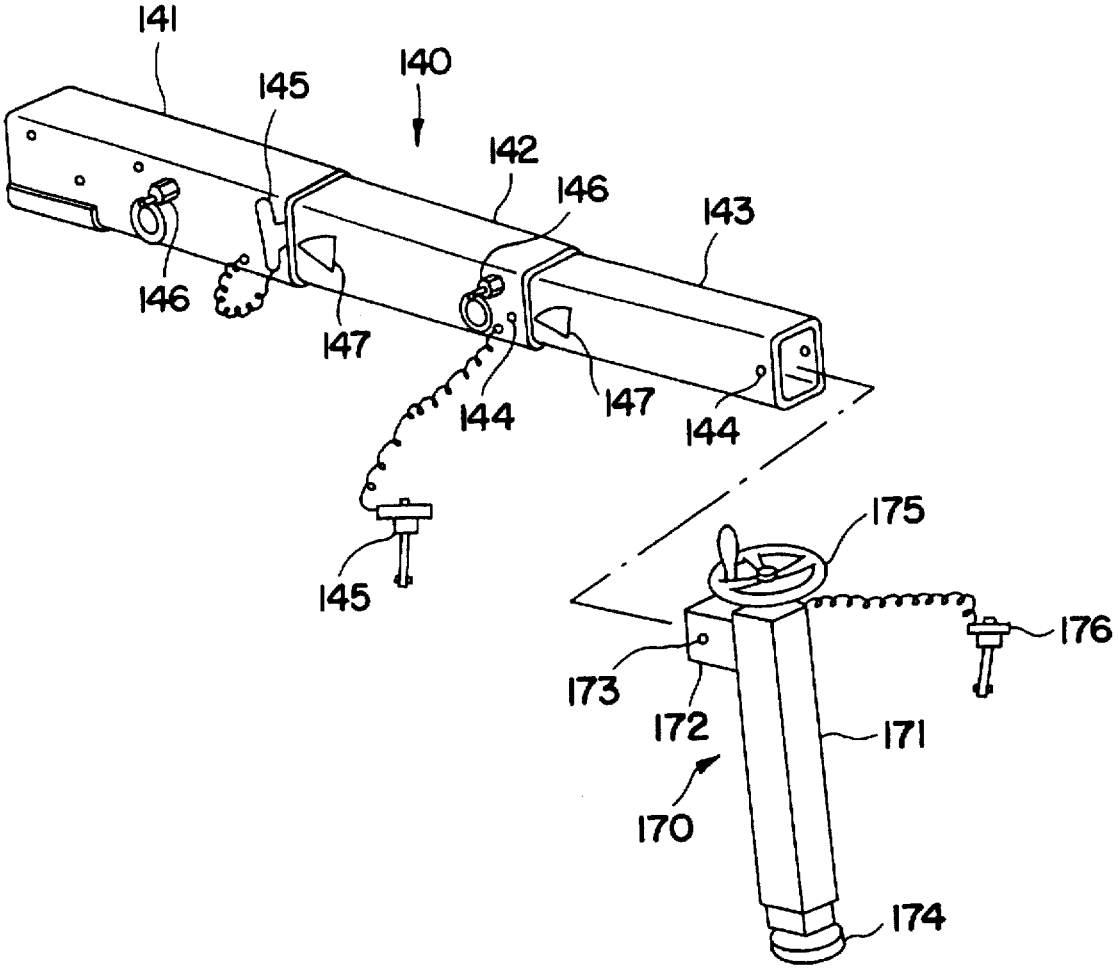
FIG. 7 is a perspective view of one of the outriggers and the corresponding jack of the lifting system of the embodiment of FIG. 1.
Figure 8:
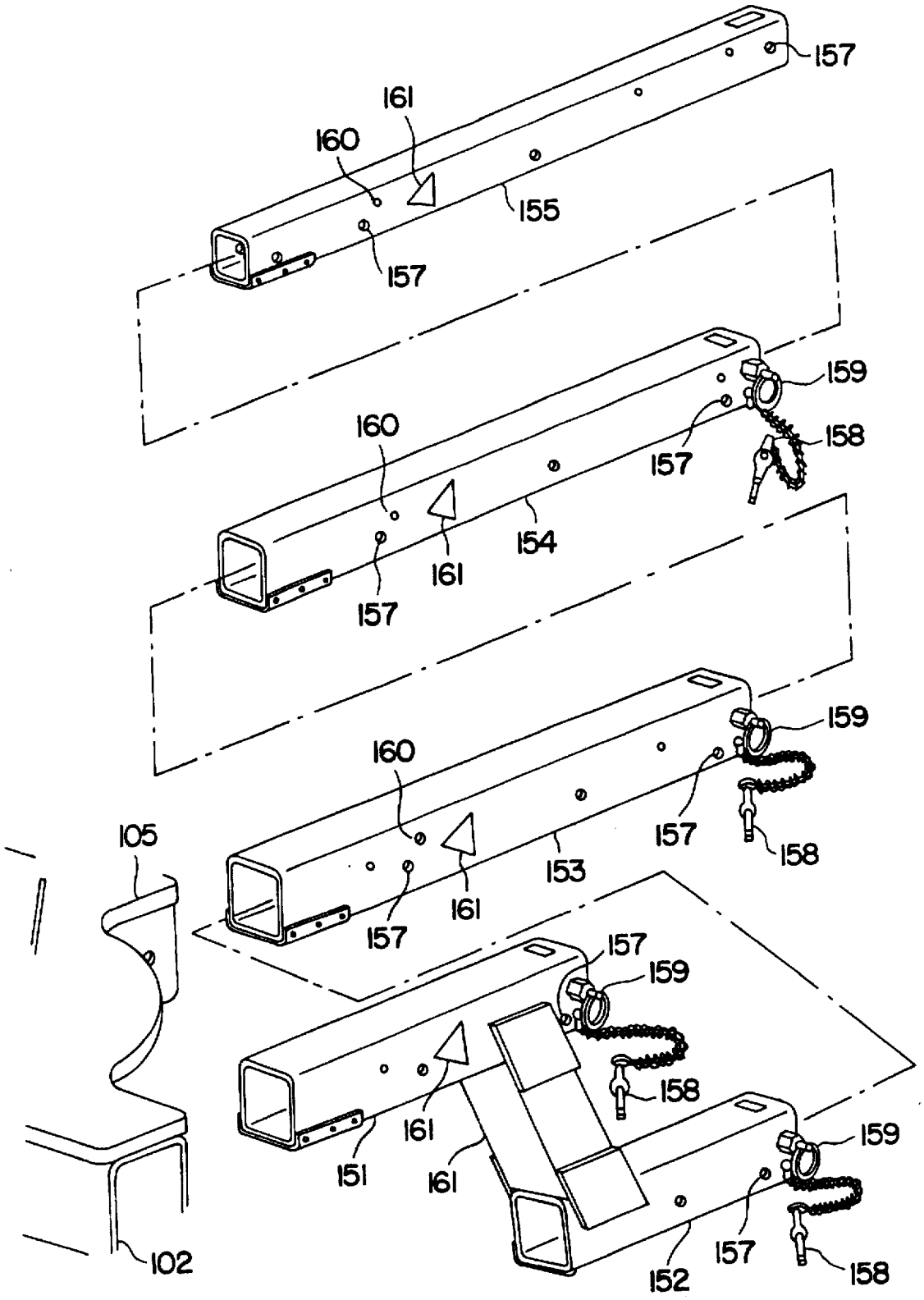
FIG. 8 is an exploded perspective view of the offset outrigger.

Each of the outriggers 140 and 150 is equipped with an adjustable jack, such as a screw jack, for transmitting the weight of the lifting system to the ground or other support surface. The linear outriggers 140 are equipped with a large jack 170, while the offset outrigger 150 is equipped with a small jack 180 which is lower in height than the large jacks 170. FIG. 7 illustrates an example of one of the large jacks 170. The jack 170 includes a housing 171 having a flange 172 which is shaped such that it may be inserted into the outer end of the outermost section 143 of any one of the linear outriggers 140. The flange 172 can be secured to the outrigger 140 by a pin 176 which may be inserted through a hole 173 in the flange and a hole 144 in the end of the outermost section 143. The housing 171 is mounted on a base 174 and may be raised and lowered with respect to the base by a hand wheel 175 on the upper end of the housing 171. When not in use, each jack 170 may be stowed on a flange 104 secured to the frame 101 of the base 100. Each flange 104 is shaped to receive the flange 172 of the jack 170. The jack 170 may be detachably secured to the flange 104 by passing an engaging member such as a quick-release pin 176 through the hole 173 in the flange 172 of the jack 170 and a corresponding hole formed on the flange 104 of the frame 101. The large jacks 170 are not restricted to the illustrated structure, and any type of lifting device known in the art may instead be employed to support the outer ends of the outriggers 140.

Figure 9:
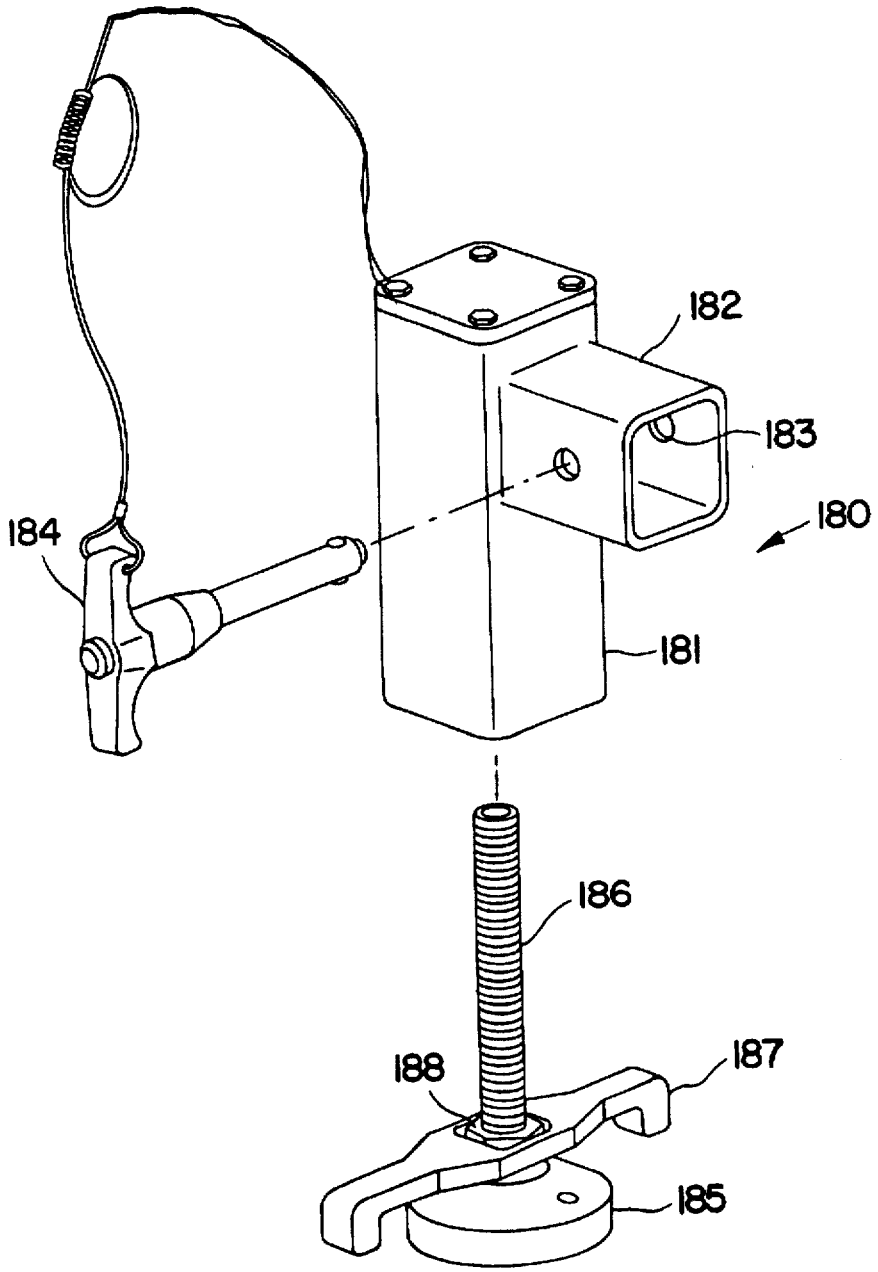
FIG. 9 is an exploded perspective view of the small jack for the offset outrigger.

FIG. 9 illustrates an example of the small jack 180. Like the large jacks 170, the small jack 180 includes a housing 181, a flange 182 which may be inserted into the outermost section 155 of the offset rigger 150, and a pin 184 which may pass through a hole 183 formed in the flange 182 and a hole 157 in the end of the outermost section 155 to secure the jack 180 to the outermost section 155. When not in use, the small jack 180 may be stowed on one of the flanges 104 of the frame 101 in the same manner as the large jacks 170. The housing 181 is mounted on a base 185 in a manner such that the housing 181 can be raised and lowered with respect to the base 185. In the present embodiment, a screw 186 extends upwards from the base 185, and a handle 187 is mounted on the screw 186 by a nut 188 which is secured to the handle 187 and threadingly engaged with the screw 186. The housing 181 fits over the screw 186 and rests on the handle 187. When the handle 187 is rotated, it moves along the length of the screw 186 and thereby raises or lowers the housing 181. This mechanism enables the jack 180 to be raised and lowered from its lower end, which is advantageous when there is very little clearance between the upper end of the jack 180 and an obstruction. However, the small jack 180 need not have the illustrated structure and may be any device capable of lifting the outer end of the offset rigger 150. The illustrated jack 180 may be extremely small, such as 4 inches or less in height, which enables it to be easily disposed beneath an aircraft such as an F-16 fighter plane, which has a minimum centerline clearance on the order of 8 inches.

The large jacks 170 and the small jack 180 extend, when aligned in a vertical orientation, downwardly beyond the circumference of the casters 112 and when adjusted by means of the handles 175, 187, provide rigidity for the lifting system. Essentially, the jacks 170, 180, when adjusted, raise the base 100 so that the casters 112 are not in contact with the ground or other support surface.

The lifting system includes a detachable towing fixture 190 for use when transporting the lifting system. The towing fixture 190 has at one end a clevis 191 for attachment to the frame 101 or to the outriggers by a clevis pin 192, and at the other end a ring 193 for connection to a towing hitch on a towing vehicle. It may also include a towing bar 195 by means of which the lifting system can be moved about by hand. The towing bar 195 includes a handle 196 at one end and a clevis 197 at its other end which can be attached to the frame 101 or to the outriggers in the same manner as the towing fixture 190. When not in use, the towing bar 195 may be stowed in any desired location of the lifting system, such as on the front of the lifting assembly 200 atop the winch 250. In the illustrated embodiment, the towing bar 195 is supported by brackets 198 mounted on the front of the lifting assembly 200 and receiving the handle 196 of the towing bar 195.

During a lifting operation, the outriggers 140 and 150 are connected to the base 100 and extended until their outer ends are a suitable distance from the base 100. The jacks 170 and 180 are then attached to the outer ends of the outriggers, and the bases of the jacks are lowered until they contact the ground. Because the outer end of the offset outrigger 150 is extremely close to the ground, it can pass underneath objects having a clearance too small for the other outriggers 140.

When it is desired to move the lifting system to a new location, the jacks 170 and 180 are removed from the ends of the outriggers 140 and 150 and stowed on the mounting flanges 104 on the base 100. The outriggers 140 and 150 are then retracted. The lifting system can then be readily moved about. Alternatively, the outriggers 140 and 150 may be detached from the base 100 during transport.

Figure 10:
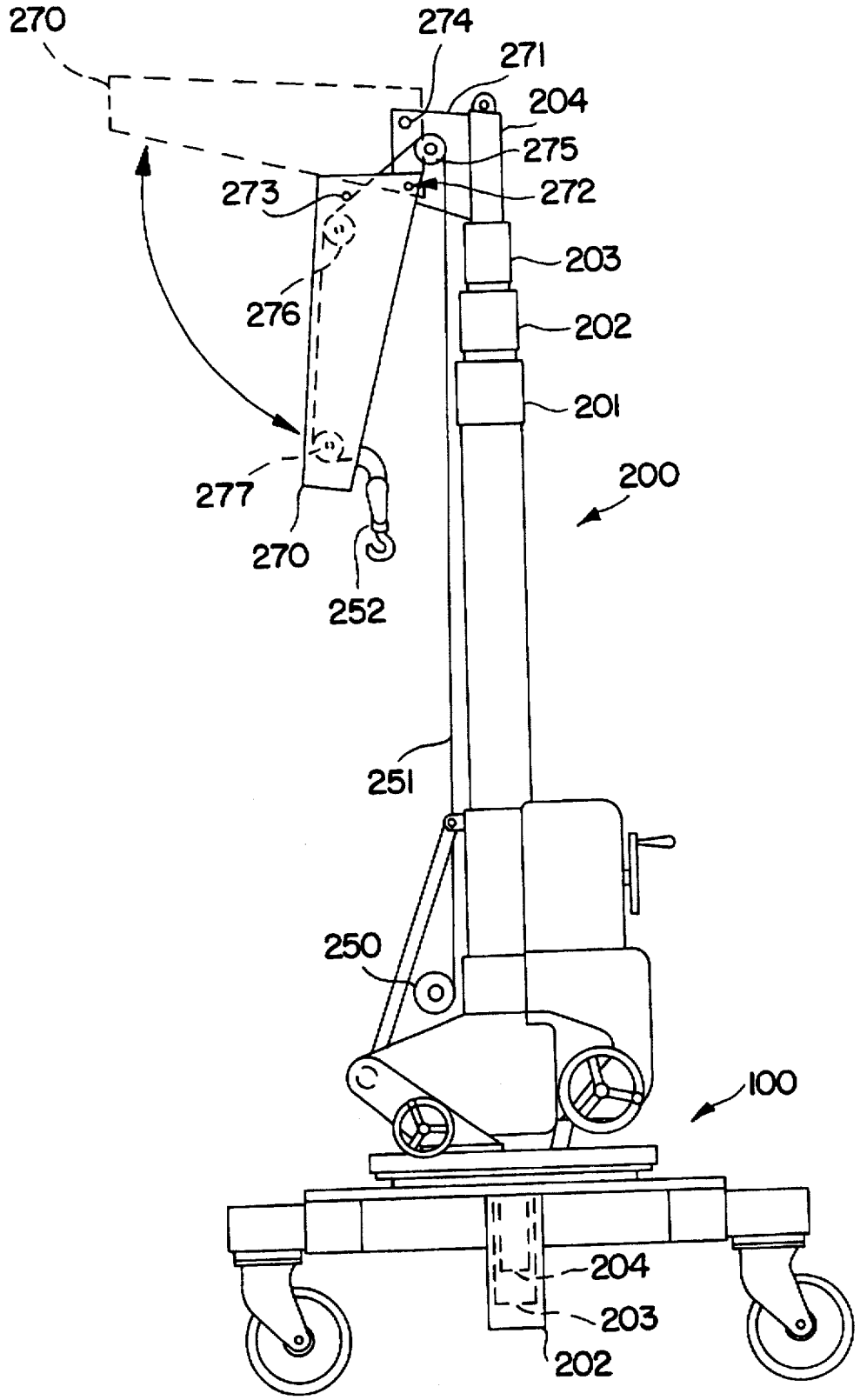
FIG. 10 is a side elevation of another embodiment of a lifting system according to the present invention.
Figure 11:
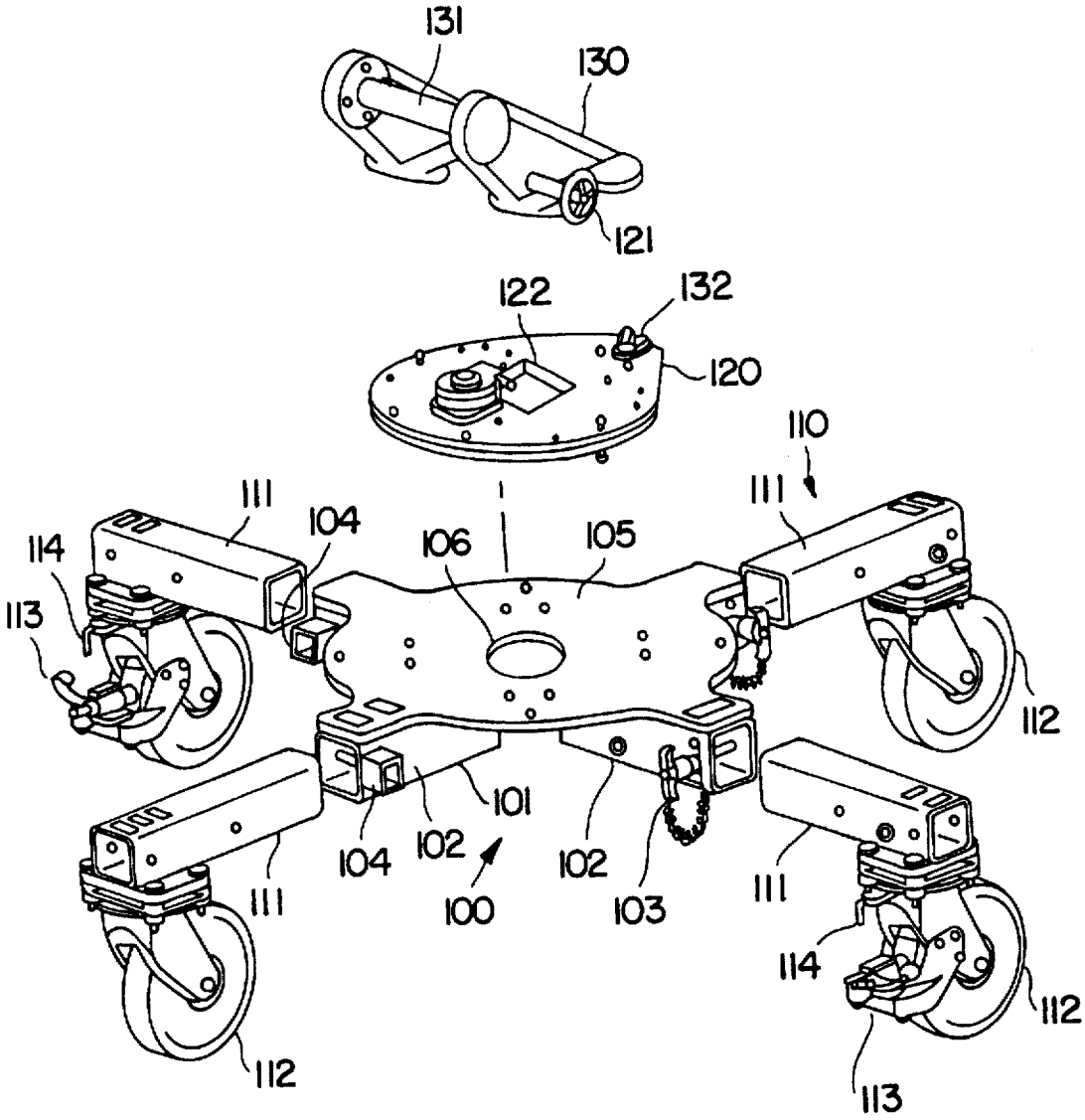
FIG. 11 is an exploded perspective view of the base of the embodiment of FIG. 10.

FIGS. 10 and 11 illustrate a modification of the embodiment of FIGS. 1–9. The overall structure of this embodiment may be similar to that of the previous embodiment. Like that embodiment, it includes a lifting assembly 200 having a plurality of telescoping booms 201–204 and a lifting arm 270 supported by the uppermost boom 204. In contrast to the lifting arm 205 of the previous embodiment which is secured at a constant angle to the uppermost boom 204, the lifting arm 270 of this embodiment can be moved with respect to the uppermost boom 204 between a raised position, shown by dashed lines, in which it extends transversely from the uppermost boom 204 and can perform lifting, and a lowered position, shown by solid lines, in which it extends generally towards the base 100 of the lifting system. When the lifting arm 270 is in its lowered position, the lifting system has a much smaller profile than when the lifting arm 270 is in its raised position, so the lifting system is easier and safer to transport.

The lifting arm 270 can move between its raised and lowered positions by any type of movement. In the present embodiment, a lower portion of the lifting arm 270 is pivotably connected to a mounting plate 271 secured to the uppermost boom 204 for pivoting a pivot point 272. The lifting arm 270 can be releasably secured in its raised position by one or more securing members, such as bolts, pins, or various types of detent mechanisms which engage the lifting arm 270 and the mounting plate 271. For example, the lifting arm 270 and the mounting plate 271 can be formed with through holes 273 and 274, respectively, which can be aligned when the lifting arm 270 is in its raised position, and an unillustrated bolt can be passed through the aligned holes to maintain the lifting arm 270 in its raised position. When the bolt or other securing member is withdrawn from the holes, the lifting arm 270 can pivot about the pivot point 272 to its lowered position.

There are no restrictions on the interior structure of the lifting arm 270. For example, it may have an interior structure similar to the lifting arm 205 of FIG. 6. As shown in FIG. 10, a cable 251 for supporting a lifting hook 252 passes over a pulley 275 installed on the mounting plate 271 and over pulleys 276 and 277 installed within the lifting arm 270.

The lifting arm 270 in this embodiment is arranged so that it can be pivoted between its raised and lowered positions by the winch 250. When the lifting arm 270 is in its lowered position and the winch 250 is operated to reel in the cable 251, if the end of the cable 251 connected to the lifting hook 252 is prevented from moving with respect to the lifting arm 270 (such as by abutment of the lifting hook 252 against some portion of the lifting arm 270), the cable 251 exerts a clockwise torque on the lifting arm 270 about the pivot point 272, causing the lifting arm 270 to pivot clockwise in FIG. 10 to its raised position. When the lifting arm 270 is in its raised position and the winch 250 is operated to pay the cable 251 out, the lifting arm 270 will pivot under the force of gravity in the counterclockwise direction about the pivot point 272 to its lowered position. The lifting arm 270 may be instead be moved between its raised and lowered positions manually or by a different mechanism. For example, a winch separate from the winch 250 for the lifting hook 252 can be used to pivot the lifting arm 270.

In this embodiment, the base 100 has a structure such that when desired, the lower end of one or more of booms 202–204 can be retracted to beneath the upper surface of the base 100. As shown in FIG. 11, which is an exploded view of the base 100 of this embodiment, through holes 122 and 106 each large enough for the lower ends of booms 202–204 to pass through are formed in the turntable 120 and the support plate 105 of the base 100, respectively. When booms 202–204 are vertically disposed and the holes 122 and 106 are superimposed on one another, the lower end of one or more of booms 202–204 can be lowered through the holes. The holes 122 and 106 can be located so that they are superimposed such that booms 202–204 can pass through them only at certain rotational positions of the turntable 120, or they can be located so as to be superimposed at any rotational position. In the present embodiment, both holes 122 and 106 are concentric with the axis of rotation of the turntable 120 so that the holes are superimposed and the booms 202–204 can be passed through the holes at any rotational position of the turntable 120. The shape of the holes 122 and 106 is not critical and they need not have the same shape as each other. In FIG. 11, the hole 122 in the turntable 120 has a rectangular shape similar to the peripheral shape of boom 202 so as to fit relatively closely around it, while the hole 106 in plate 105 is a circle with a diameter larger than any diagonal of hole 122 so that booms 202–204 can pass through hole 106 at any rotational position of the turntable 120. The turntable 120 may even be rotated with the booms extending through hole 106. The booms may extend through the holes 122 and 106 by any desired amount, but preferably by an amount such that boom 202 does not contact the surface on which the base 100 is supported.

A mechanism for raising and lowering the booms in this embodiment can be the same as that used in the previous embodiment. FIG. 10 shows all three of booms 202–204 extending through the upper surface of the base 100 when the booms are fully retracted with respect to each other, but less than all of booms 202–204 may extend through the upper surface.

Figure 6:
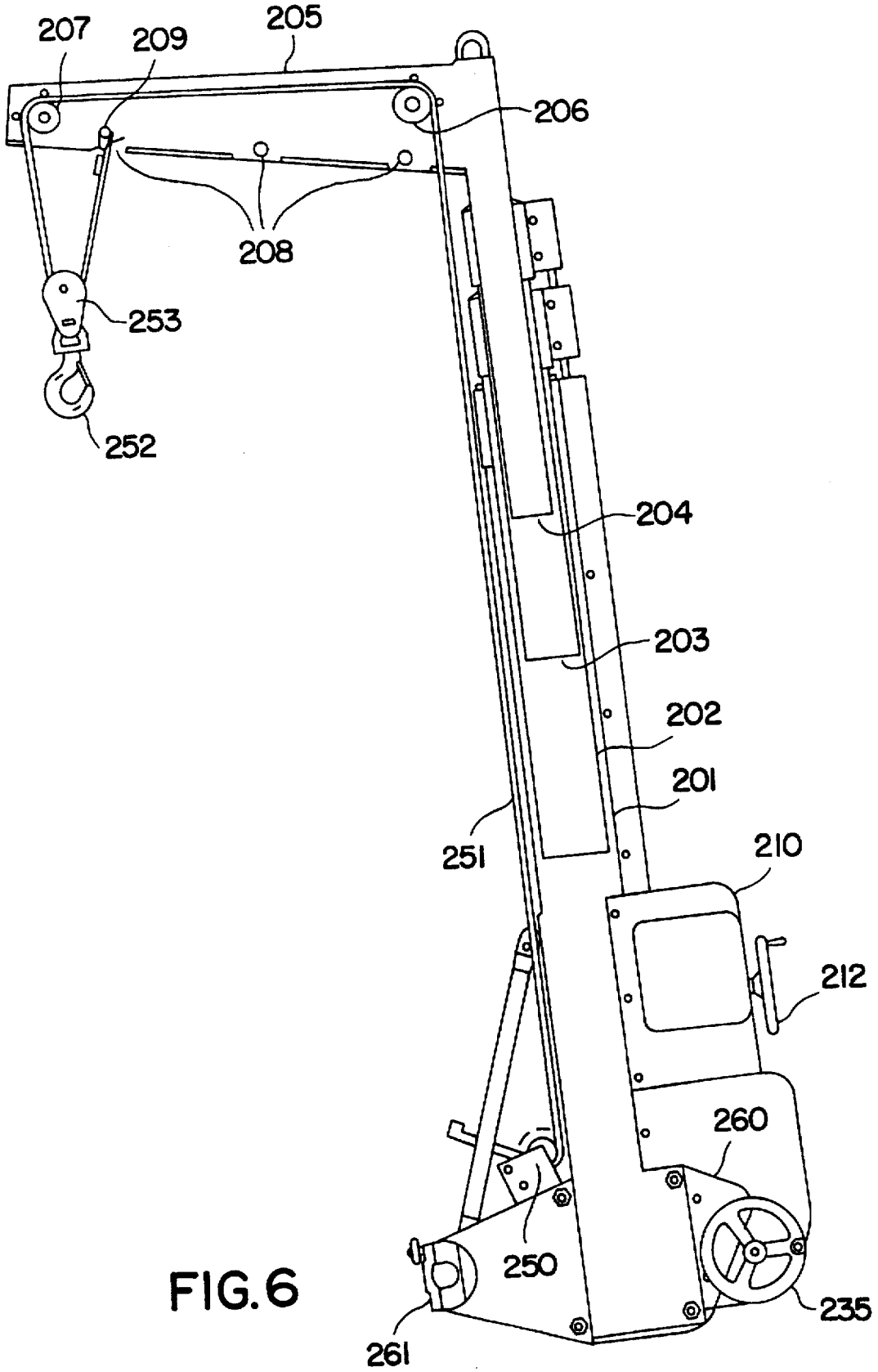
FIG. 6 is a side view of the lifting assembly showing the path of the lifting cable.

Comparing the embodiment of FIG. 6 with the embodiment of FIG. 10, if the first boom 201 in each embodiment has the same height, then the other booms 202–204 can be longer in FIG. 10 than in FIG. 6, so the overall length of the booms 201–204 in a fully raised state (shown in FIG. 1, for example) can be greater for the embodiment of FIG. 10 with no increase in the overall height of the apparatus when the booms are in a fully lowered state (shown in FIGS. 6 and 10). On the other hand, the first boom 201 in FIG. 10 can be made shorter than the first boom 201 in FIG. 6 with no decrease in the overall length of the booms 201–204 in a fully raised state, since a decrease in the length of the first boom 201 can be compensated by an increase in the length of one of the other booms 202–204. As a result of a decrease in the length of the first boom 201, the embodiment of FIG. 10 can have a lower overall height in a lowered state than the embodiment of FIG. 6 with no decrease in lifting ability, making the embodiment of FIG. 10 easier to transport and store.

Although not shown in the drawings, the embodiment of FIGS. 10 and 11 may be equipped with outriggers like those employed in the embodiment of FIGS. 1–9.

Figure 12:
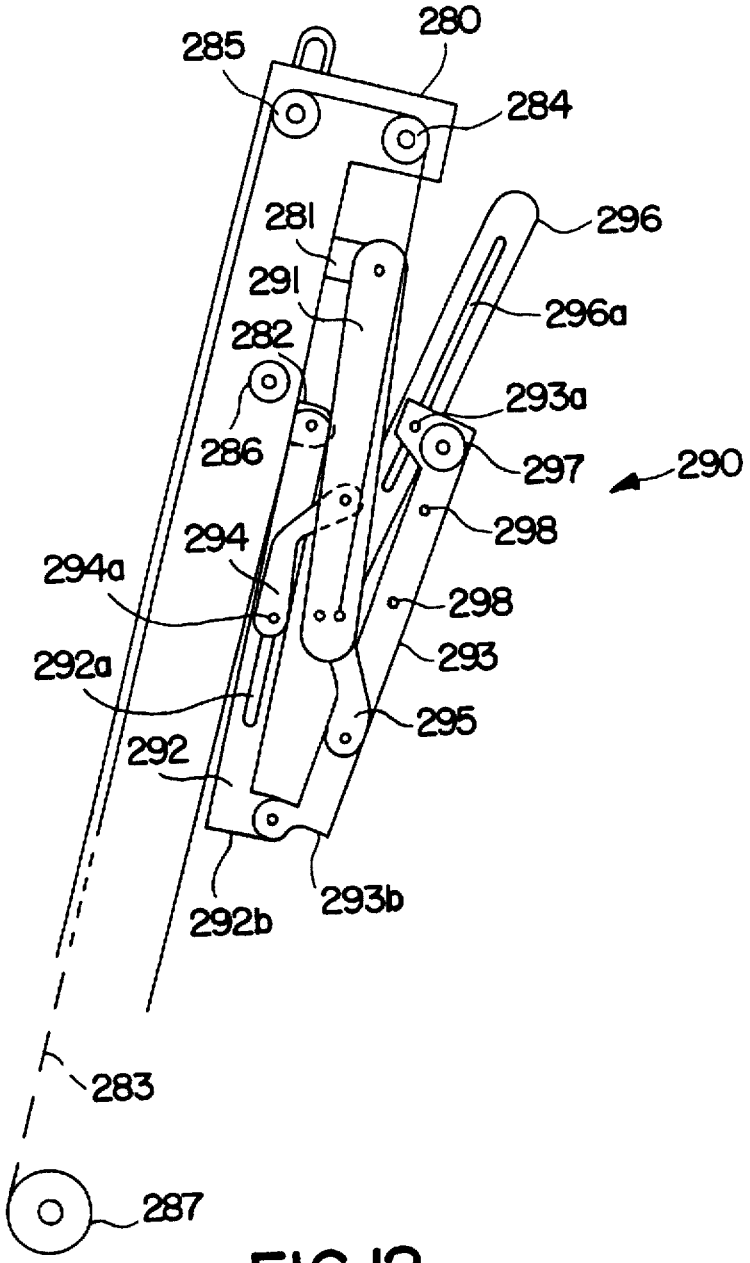
FIGS. 12–15 are side elevations of a boom having a folding lifting arm which can be employed in the present invention.
Figure 13:
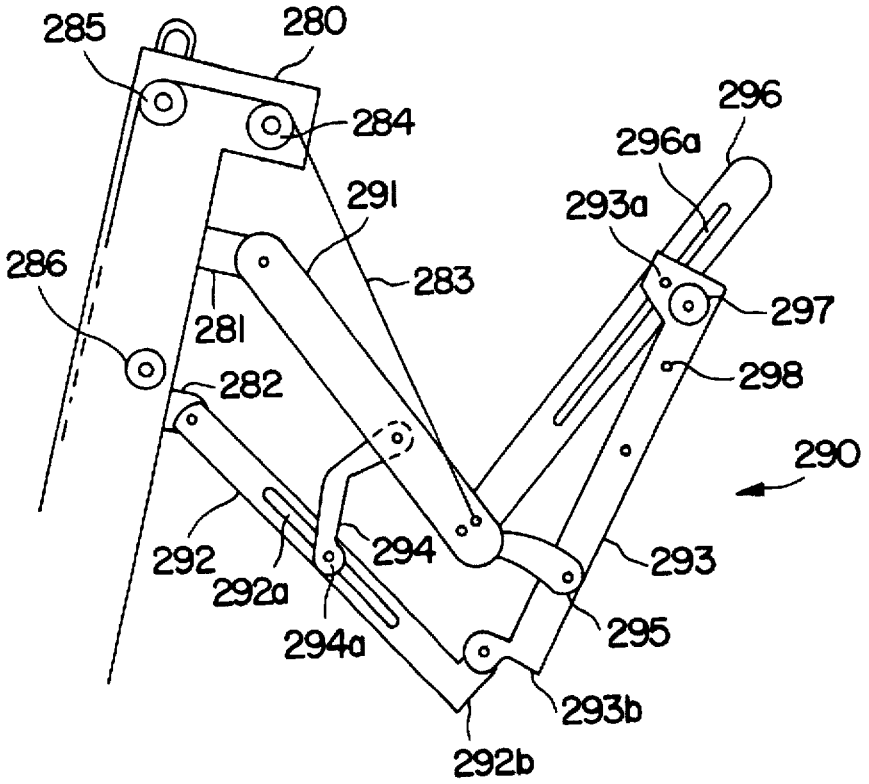
Figure 14:
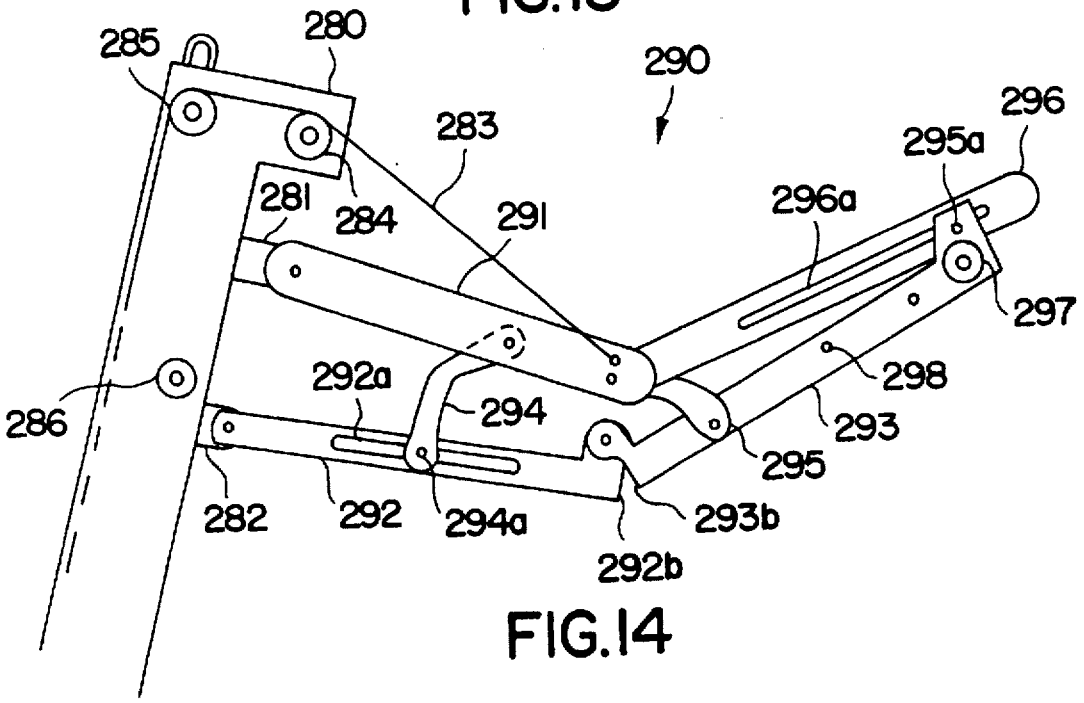
Figure 15:
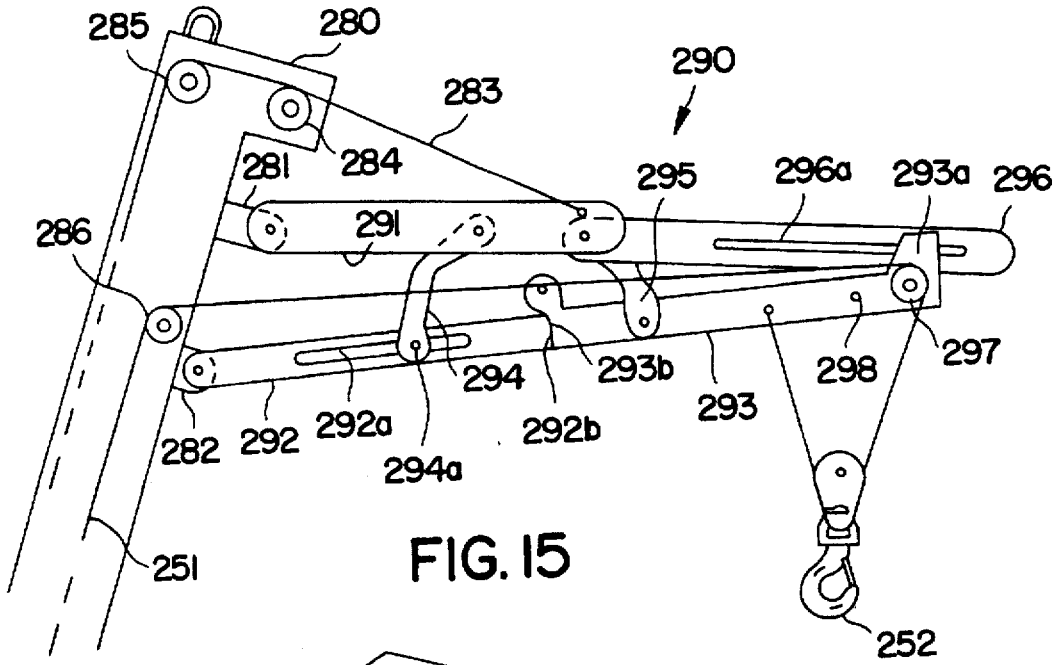
Figure 16:
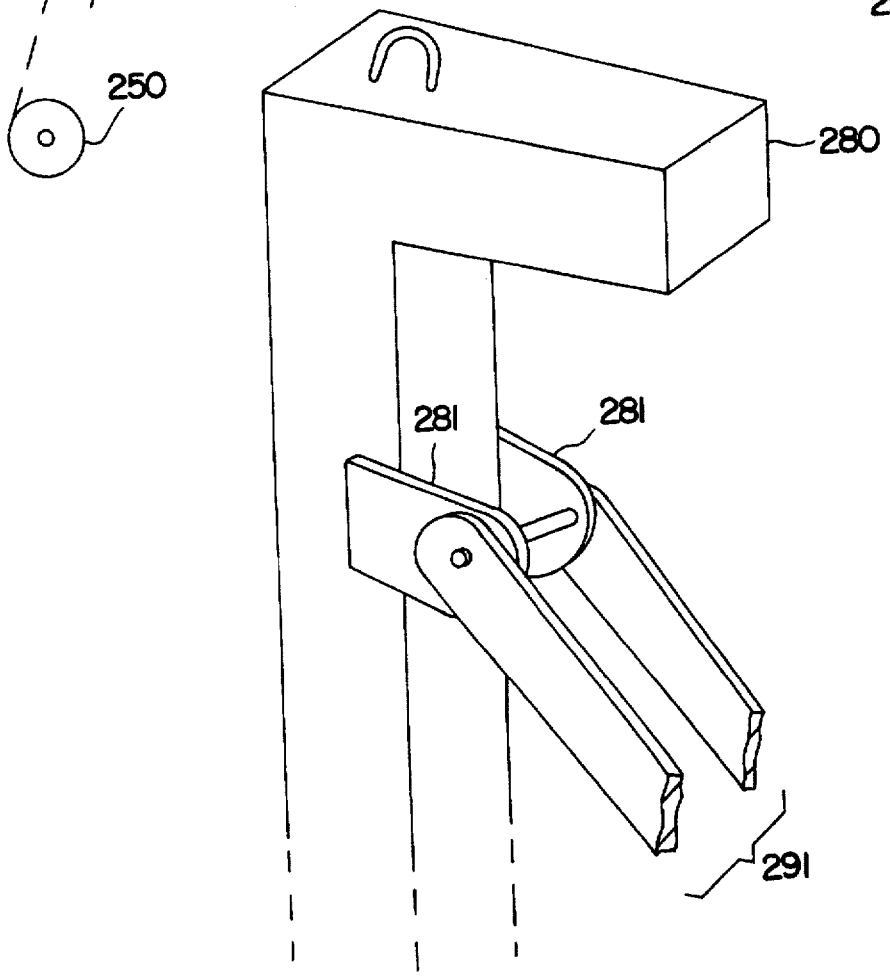
FIG. 16 is a perspective view of an example of a link including a plurality of members disposed in tandem.

FIGS. 12–15 are side views of an example of a folding lifting arm 290 which can be used in place of the lifting arms 205 and 270 employed in the previous embodiments. This lifting arm 290 can be folded up to achieve a highly compact state for transport or storage of the lifting assembly, and it can be extended, i.e., unfolded when it is to be used for lifting. FIG. 12 shows the lifting arm 290 in a folded state, FIG. 15 shows the lifting arm 290 in an extended state, and FIGS. 13 and 14 show the lifting arm 290 at progressively more extended states between the folded and extended states. As shown in these figures, the lifting arm 290 comprises a plurality of interconnected links 291–296 which are mounted on the side of a boom 280, which may be used in place of the uppermost boom 204 of any of the preceding embodiments, for example. A first link 291 has a first end pivotably connected to a mounting lug 281 of the boom 280 and a second end. A second link 292 has a first end pivotably connected to another mounting lug 282 of the boom 280 disposed below mounting lug 281 and a second end. A third link 293 has a first end pivotably connected to the second end of the second link 292 and a second end. A fourth link 294 has a first end connected to the first link 291 and a second end connected to the second link 292. Each end of the fourth link 294 is able to pivot with respect to the link to which it is connected. In addition, one of the ends of the fourth link 294 is slidably connected to one of links 291 and 292. In this embodiment, the first end of the fourth link 294 is pivotably connected to the first link 291 at a pivot point which is stationary with respect to the first link 291, while the second end of the fourth link 294 is both slidably and pivotably connected to the second link 292 for pivoting about a pivot point which can translate along the second link 292. The fourth link 294 can be connected to the second link 292 in any suitable manner, such as by a pin 294*a* on the fourth link 294 which is slidably and rotatably received in an elongated slot 292*a* in the second link 292. A fifth link 295 has a first end pivotably connected to the first link 291 and a second end pivotably connected to the third link 293 between the two ends of the third link 293. The lifting arm 290 may further include a sixth link 296 having a first end pivotably connected to the first link 291, such as at the second end of the first link 291, and a portion which is slidably and rotatably connected to the third link 293 in any suitable manner. For example, the sixth link 296 may have an elongated slot 296 which slidably and rotatably receives a pin 293*a* mounted on the second end of the third link 293. All of the axes about which the links are pivotable are parallel to one another and extend normal to the plane of the drawings. The links can have any desired structure and need not be shaped in the manner shown in the figures. To give the lifting arm 290 greater torsional rigidity, one or more of the links may comprise a plurality of members disposed in tandem. For example, as shown in FIG. 16, the first link 291 may comprise a plurality of parallel plates spaced from each other in the horizontal direction.

The lifting arm 290 can be extended from its folded state shown in FIG. 12 by the exertion of a force on some portion of the lifting arm 290 which will cause the first and second links 291 and 292 to pivot in the counterclockwise direction in the figures about the mounting lugs 281 and 282. Any suitable mechanism can be employed to exert a force in the appropriate direction. In this embodiment, the lifting arm 290 is extended by a cable 283 which has one end secured to the first link 291 near its second end. The cable 283 passes over pulleys 284 and 285 mounted on the boom 280 and is connected to a device which can produce translation of the cable 283, such as a winch 287 or a hydraulic cylinder installed in any convenient location. The cable 283 may pass along either the inside or the outside of the boom 280. When the cable 283 is reeled in by the winch 287, i.e., when it is pulled in the direction of the arrows in FIGS. 13 and 14, the first link 291 is rotated counterclockwise about mounting lug 281 and the lifting arm 290 is extended. Examples of other devices which can be used to extend the lifting arm 290 are a motor which can rotate one of the first or second links 291 and 292 about the corresponding mounting lug 281 and 283, and hydraulic or pneumatic cylinders which can be driven to exert a torque on one of links 291 and 292.

A load to be lifted can be attached to the lifting arm 290 in any suitable manner and in various locations. As shown in FIG. 15, a lifting hook 252 for attachment to a load may be suspended from the lifting arm 290 by a cable 251. One end of the cable 251 can be detachably connected to one of a plurality of attachment points 298 on one of the links, such as the third link 293, while the other end can be connected to a winch 250 or other suitable mechanism for reeling in and paying out the cable 251. Between its two ends, the cable 251 passes over a pulley 286 mounted on the upper end of the boom 280 and a pulley 297 mounted on the outer end of the lifting arm 290, such as on the second end of the third link 293.

To give the lifting arm 290 rigidity when it is supporting a load, the second and third links 292 and 293 are preferably equipped with a rotation limiting arrangement which limits the amount by which the third link 293 can rotate about the second end of the second link 292 in the clockwise direction. An example of a rotation limiting arrangement is one in which portions of links 292 and 293 come into firm contact with each other when these links 292 and 293 are at a prescribed rotational position with respect to each other. In the present embodiment, the adjoining ends of the second link 292 and the third link 293 have stopping surfaces 292*b* and 293*b*, respectively, which abut against each other when the lifting arm 290 is in its unfolded state shown in FIG. 15. The abutment prevents the third link 293 from pivoting in the clockwise direction with respect to the second link 292 beyond a predetermined angle. The angle between the second and third links 292 and 293 at which the surfaces 292*b* and 293*b* abut is not critical. In the present embodiment, the angle between links 292 and 293 is approximately 180 degrees when surfaces 292*b* and 293*b* abut to give the lifting arm 290 the maximum possible extension.

The weights of the individual links and the positions of their centers of gravity are such that when the lifting arm 290 is in its extended state and is not supporting a load other than the lifting hook 252, the lifting arm 290 will fold up from its extended state to its folded state under its own weight unless a restraining torque is exerted on the lifting arm 290 by cable 283. Thus, when the lifting arm 290 is unloaded, the lifting arm 290 can be folded up simply by paying out cable 283.

Figure 17A:
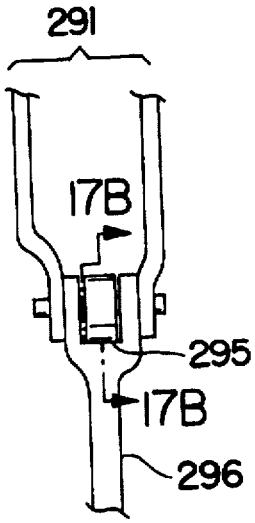
FIG. 17A is a top view of a portion of the lifting arm of FIGS. 12–15.
Figure 17B:
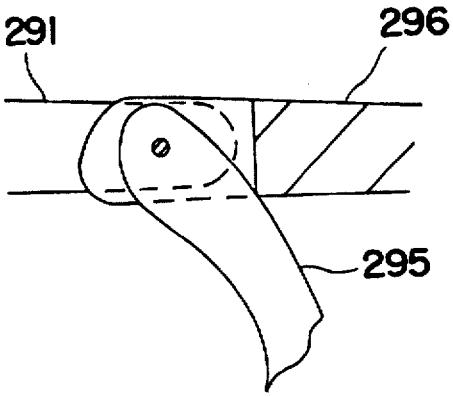
FIG. 17B is a cross-sectional view taken along line 17B—17B of FIG. 17A.

The lifting arm 290 can be maintained in its extended state during a lifting operation in a variety of ways. For example, a counterclockwise torque can be exerted on the first or second links 291 or 292 about mounting lugs 281 or 282, respectively, by the same mechanism used to unfold the lifting arm 290, such as by cable 283, or pins or other stopping members can be inserted into preformed holes in the links to prevent them from pivoting with respect to each other. In the present embodiment, the lifting arm 290 is designed to be entirely self-supporting when a downward load of greater than a certain magnitude is applied to the third link 293. The downward load exerts a net clockwise torque on the third link 293 about the second end of the second link 292, and the stopping surfaces 292*b* and 293*b* of the second and third links 292 and 293 are pressed into firm contact with each other so that the second and third links 292 and 293 function as a single beam. In this state, a counterclockwise torque about mounting lug 282 is exerted on the second and third links 292 and 293 by the first and fifth links 291 and 295 to balance the clockwise torque applied by the downward load. In the state shown in FIG. 15, the fifth link 295 is locked against further counterclockwise pivoting with respect to the first link 291 or the third link 293 by its upper surface which abuts against the lower surface of the sixth link 296, as shown in FIG. 17A and 17B, which are respectively a top view of the joint between the first link 291, the fifth link 295, and the sixth link 296, and a cross-sectional view taken along line 17B—17B of FIG. 17A. Alternatively, the counterclockwise pivoting of the fifth link 295 may be limited by engagement of the fifth link 295 with some portion of the first link 291 or the third link 293. As another alternative, there may be no restriction on the pivoting of the fifth link 295, and the second and third links 292 and 293 may pivot about mounting lug 282 until the first link 291 and the fifth link 295 are substantially axially aligned and function as a catenary to support the second and third links 292 and 293. In the position shown in FIG. 15 in which the fifth link 295 abuts against the sixth link 296, as long as a downward load greater than a predetermined level is applied to the third link 293, the lifting arm 290 is prevented from folding up, and cable 283 may be relaxed, although it may be desirable to maintain some tension in cable 283 to prevent the lifting arm 290 from folding up if the load is suddenly released. With the cable 283 relaxed, the load can be transmitted to the boom 280 entirely by the links of the lifting arm 290, so cable 283 need not be capable of withstanding any greater load than that applied to it during folding and extending of the lifting arm 290 in an unloaded state.

In the embodiment of FIG. 15, due to the engagement between the fifth link 295 and the sixth link 296 which limits the counterclockwise pivoting of the fifth link 295, the sixth link 296 supports a portion of the downward load applied to the lifting arm 290. However, if there is no locking engagement between the fifth and sixth links 295 and 296, the sixth link 296 may serve primarily to give the lifting arm 290 stiffness in torsional bending about an axis lying in the plane of the drawings without supporting the downward load. In this case, the sixth link 296 may be omitted without affecting the operation or the lifting strength of the lifting arm 290.

The lifting arm 290 illustrated in FIGS. 12–15 is not limited to use with lifting assemblies like those shown in FIGS. 1–11 and can be employed with any type of lifting device.

Although shown and described are what is believed to be the more practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. A lifting system comprising:

a base;

a boom mounted on the base for supporting a load; and a plurality of outriggers connected to the base to provide stability to the base during a lifting operation, the outriggers including an offset outrigger including an upper portion connected to the base and a lower portion longer than the upper portion, the upper portion having a bottom external surface disposed above a top external surface of the lower portion, the lower portion of the offset outrigger including a first section and a second section telescoped with respect to the first section, the upper portion being shaped so that the second section can be telescoped with respect to either the upper portion or the first section of the lower portion with a fit permitting the transmission of a vertical load, the upper and lower portions each extending substantially horizontally, the offset outrigger further including an offset connecting member interconnecting the upper and lower portions.

2. A lifting system as claimed in claim 1 wherein the connecting member extends diagonally between the upper and lower portions.

3. A lifting system as claimed in claim 1 including a plurality of support members each connected to an outer end of one of the outriggers to support the outer end above a surface.

4. A lifting system as claimed in claim 3 wherein each of the support members comprises a jack.

5. A lifting assembly as claimed in claim 1 including a jack attached to an outer end of the lower portion of the offset outrigger, the jack having an adjusting member for adjusting a height of the jack located below the outer end of the offset outrigger.

6. A lifting system as claimed in claim 5 wherein the adjusting member comprises a handle adjoining a lower end of the jack.

7. A lifting system as claimed in claim 1 wherein the base includes a plurality of caster assemblies each including a hollow leg and a caster attached to the leg, each leg having a bore sized to receive any one of the outriggers.

8. A lifting system comprising:

a base;

a boom mounted on the base for supporting a load; and a plurality of outriggers connected to the base to provide stability to the base during a lifting operation, the outriggers including an offset outrigger and a nonoffset outrigger, the nonoffset outrigger having an inner end connected to the base and an outer end spaced from the base and located at substantially a same height as the inner end, the offset outrigger having an inner end connected to the base and an outer end spaced from the base and located lower than the inner end of the offset outrigger and the outer end of the nonoffset outrigger, whereby the outer end of the offset outrigger can be passed beneath an obstruction too low for the outer end of the nonoffset outrigger.

9. A lifting system comprising:

a base;

a boom supported atop the base; and a folding lifting arm supported by the boom and having an inner end connected to the boom, an outer end from which a load can be supported, and an intermediate portion between the inner and outer ends, the lifting arm being movable by folding of the lifting arm about the intermediate portion between a folded position and an unfolded position in which the outer end of the lifting arm is located farther from the boom than in the folded position, a height of the intermediate portion being less in the folded position than in the unfolded position, the lifting arm including:

a first link having first and second ends, the first end being pivotably connected to the boom at a first position;

a second link having first and second ends, the first end being pivotably connected to the boom at a second position below the first position;

a third link having first and second ends, the first end being pivotably connected to the second end of the second link;

a fourth link having first and second ends, the first end being pivotably connected to the first link and the second end being slidably connected to the second link; and a fifth link having first and second ends, the first end being pivotably connected to the first link and the second end being pivotably connected to the third link.

10. A lifting system as claimed in claim 9 wherein the lifting arm further comprises a sixth link having a first end and a slidable engagement portion, the first end being pivotably connected to the second end of the first link and the slidable engagement portion being slidably and rotatably connected to the second end of the third link.

11. A lifting system as claimed in claim 9 wherein the lifting arm includes a stop resisting folding of the lifting arm about the intermediate portion when the lifting arm is in its unfolded position.

* * * * *

UNITED STATES PATENT AND TRADEMARK OFFICE

CERTIFICATE OF CORRECTION

PATENT NO. : 5,758,785
DATED : June 2, 1998
INVENTOR(S) : Dominic Spinosa et al.

It is certified that error appears in the above-identified patent and that said Letters Patent is hereby corrected as shown below:

Title page,
Item [73], Assignee, add:
-- East/West Industries, Inc. --.

Signed and Sealed this

Sixth Day of September, 2005

JON W. DUDAS
*Director of the United States Patent and Trademark Office*